US007204523B2

(12) United States Patent
Wang

(10) Patent No.: US 7,204,523 B2
(45) Date of Patent: Apr. 17, 2007

(54) HOSE CONNECTOR FOR HOSE OF A DUST COLLECTOR

(76) Inventor: Chun Hsiang Wang, P.O. Box 82-144, Taipei (TW)

( * ) Notice: Subject to any disclaimer, the term of this patent is extended or adjusted under 35 U.S.C. 154(b) by 0 days.

(21) Appl. No.: 10/426,866

(22) Filed: May 1, 2003

(65) Prior Publication Data

US 2004/0217591 A1 Nov. 4, 2004

(51) Int. Cl.
*F16L 5/00* (2006.01)

(52) U.S. Cl. ..... 285/194; 285/7; 415/205; 15/330; 406/101

(58) Field of Classification Search ..... 406/96–103; 15/330, 422; 415/205, 213.1; 285/7, 136.1, 285/139.3, 140.1, 189, 192, 194, 201, 322, 285/901, 921, 210
See application file for complete search history.

(56) References Cited

U.S. PATENT DOCUMENTS 1,582,295 A * 4/1926 Muenzen ..... 285/7
2,343,714 A * 3/1944 Swenson ..... 406/101
4,265,592 A * 5/1981 Carlini ..... 415/205
5,638,574 A * 6/1997 Haupt et al. ..... 15/330
5,722,111 A * 3/1998 Sowell et al. ..... 185/330

* cited by examiner

*Primary Examiner*—Aaron Dunwoody
(74) *Attorney, Agent, or Firm*—Leong C. Lei

(57) ABSTRACT

A hose connector for hose of a dust collector is disclosed. The hose connector has a housing containing a blower, a blade module, a hose and the hose connector includes a covering plate, wherein the center of the covering plate of the hose connector is provided with a through hole and the lower edge next to the hose connector is protruded out an urging edge which can resist against the circumferential edge of the covering plate, and the lower edge of the hose connector is protruded out an engaging block which can engage to the lower inner edge of the through hole of the covering plate, and on the hose connector adjacent to the engaging block, a stopping pad is disposed such that when the stopping pad is at the covering plate of the hose seat the length of the stopping pad facing downward is beyond the top end of the blade module and a curved gap is formed between the stopping pad and the blade module. The hose connector of the present invention improves the efficiency of the dust collector by eliminating turbulence of the blower.

3 Claims, 7 Drawing Sheets

HOSE CONNECTOR FOR HOSE OF A DUST COLLECTOR

BACKGROUND OF THE INVENTION

1. Technical Field of the Invention

The present invention relates to a hose connector of a dust collector, and in particular, a hose connector for connecting hose of a dust collector, wherein the hose connector can be directly fastened onto the cover plate of a blower, and the hose connector allows small gaps between the blade module and the cover plate of the blower, thereby the efficiency of dust collector is greatly improved.

2. Description of the Prior Art

A dust collector is a device used to remove dust particles in a timber frill on the like factories by employing a blower to vibrate air and the dust particles in the air are collected and removed. The dust collector used in these factories is prone to be damaged due to frequent moving within the worksite. As a result, components to replace damaged parts of the dust collector have to be made in such a way that the components can be easily and conveniently employed to the dust collector, in particular the hose connector for hose used in a dust collector. As shown in FIGS. 1 and 2, there is shown structure of a conventional hose connector, wherein the center of the covering plate 10 is formed with a through hole, and the circumferential edge of the through hole of the covering plate 10 is provided with a protruded hose connector 11 for connecting the hose of the dust collector. For safety reason, a free end of the hose connector 11 is provided with a grating rim 12 for preventing the hand or other objects enter therein. However, in practice, there are drawbacks found in this conventional hose connector 11.

As shown in FIG. 2, the grating rim 12 is mounted onto the hose connector 11 (as shown in FIG. 2A) by way of point welding method, and the hose connector 11 mounted at the circumferential edge of the through hole (as shown in FIG. 2B) is by way of point welding B. Thus, during installation, there is no reference panel to support the hose connector 11. As a result, the hose connector 11 cannot easily maintain vertical, and the grating rim 12 cannot maintain at a horizontal position. In view of that welding of the grating rim 12 is not convenient and after welding procedure, electroplating or power coating of the welding A and welding B has to be performed so as to avoid oxidize, damaging the aesthetic appearance. Generally, electroplating and/or power coating is needed. As a result, the fabrication and assembly of the hose connector 11 are rather laborious and time consuming. Therefore, the cost of production is high.

Further, in order to facilitate the mounting of the hose of dust collector, the hose connector 11 is generally protruded out. This will prone to damage when the dust collector is moved from one place to another. Due to the fact that the hose connector 11 and the covering plate 10 are welded to form an integral unit, the disassembly of the component is difficult. In view of that, maintenance or repairing a damaged hose connector 11 is almost not possible.

As shown in FIG. 3, when the covering plate 10 of the hose connector is disposed on the housing 20 of the blower, the top end of the blade module 25 pivotally mounted at the inner bottom edge of the covering plate 10 and the housing 20 will form a gap D. Thus, a portion of the air stream will pass through gap D to the top of the blade module 25, and then the air stream is guided to move downward. This stream will form turbulence with the main air stream flowing in horizontal. This will reduce the dust collector efficiency, and the dust collection is poor.

In view of the above, it is an objective of the present invention to provide a hose connector for hose of a dust collector which mitigates the above drawbacks.

SUMMARY OF THE INVENTION

It is, therefore, an object of this invention to provide a hose connector for hose of a dust collector having a housing containing a blower, a blade module, a hose and the hose connector including a covering plate characterized in that the center of the covering plate of the hose connector is provided with a through hole and the lower edge next to the hose connector is protruded out an urging edge which can resist against the circumferential edge of the covering plate, and the lower edge of the hose connector is protruded out an engaging block which can engage to the lower inner edge of the through hole of the covering plate, and on the hose connector adjacent to the engaging block, a stopping pad is disposed such that when the stopping pad is at the covering plate of the hose seat the length of the stopping pad facing downward is beyond the top end of the blade module and a curved gap is formed between the stopping pad and the blade module.

Another object of this invention is to provide a hose connector for hose of a dust collector, wherein the top face of the hose connector is provided with a grating rim having a plurality of ribs to prevent large size object to enter the blower.

Still another object of this invention is to provide a hose connector for hose of a dust collector, wherein the top face of the hose connector is mounted integrally with a grating rim formed from a plurality of ribs so as to prevent large objects to enter the blower.

A still further object of this invention is to provide a hose connector for hose of a dust collector having a housing containing a blower, a blade module, a hose and the hose connector including a covering plate characterized in that the center of the covering plate of the hose connector is provided with a through hole and the covering plate at the circumferential edge of the through hole is downwardly provided with a stopping plate, and the downward height of the stopping pad is at least beyond the top end of the blade module so that a curved gap is formed between the stopping pad, and the lower edge next to the hose connector is protruded out an urging edge which can resist against the upper circumferential edge of the through hole of the covering plate, and the lower edge of the hose connector is protruded with an engaging block which can engage at the lower edge of the stopping pad of the covering plate.

Further objects of the invention together with additional features contributing thereto and advantages accruing therefrom will be apparent from the following description of a preferred embodiment of the invention which is shown in the accompanying drawings.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 2 is a perspective view of a conventional hose connector, wherein

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 4:
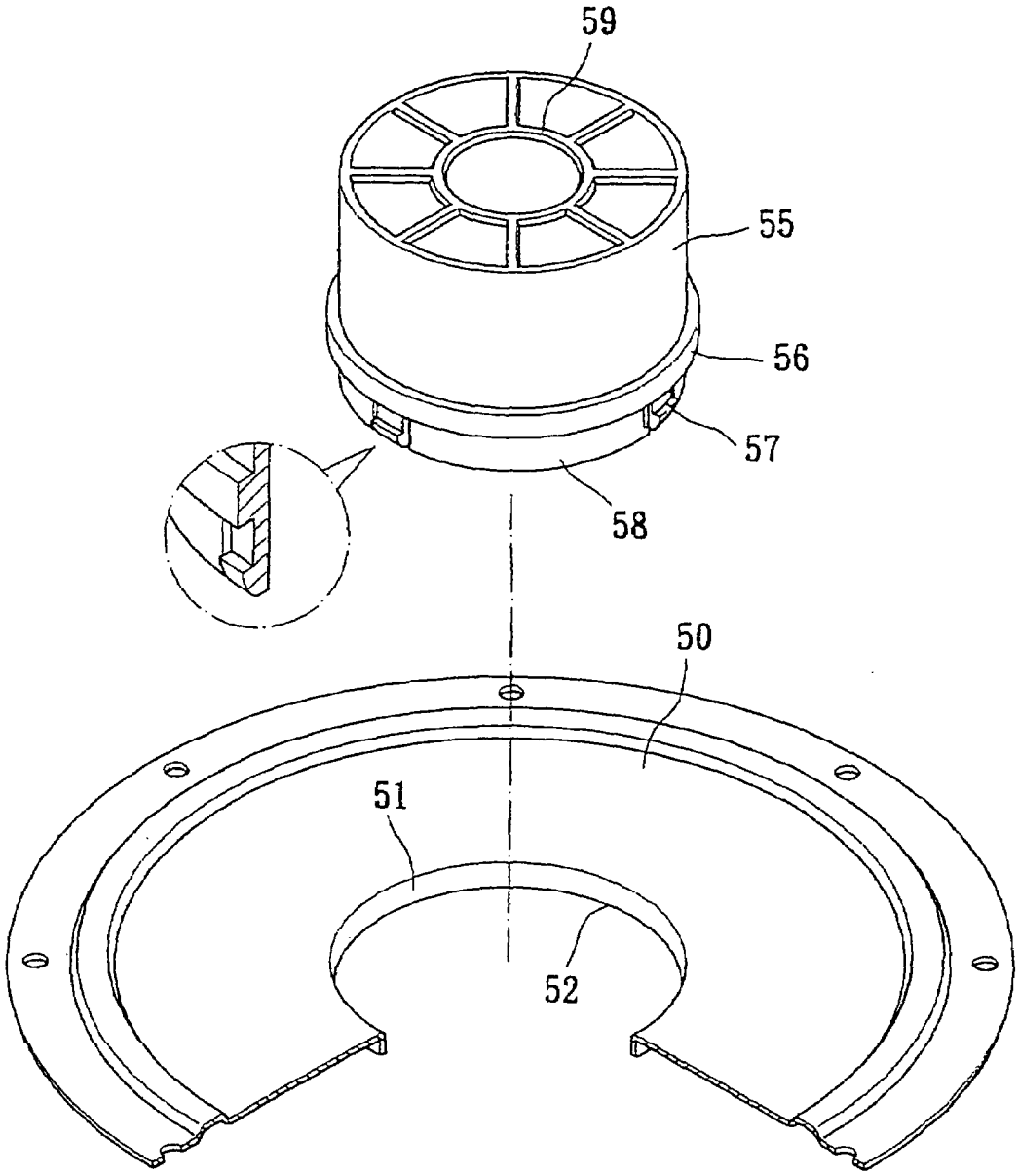
FIG. 4 is a perspective exploded view of the hose connector of the present invention.
Figure 5:
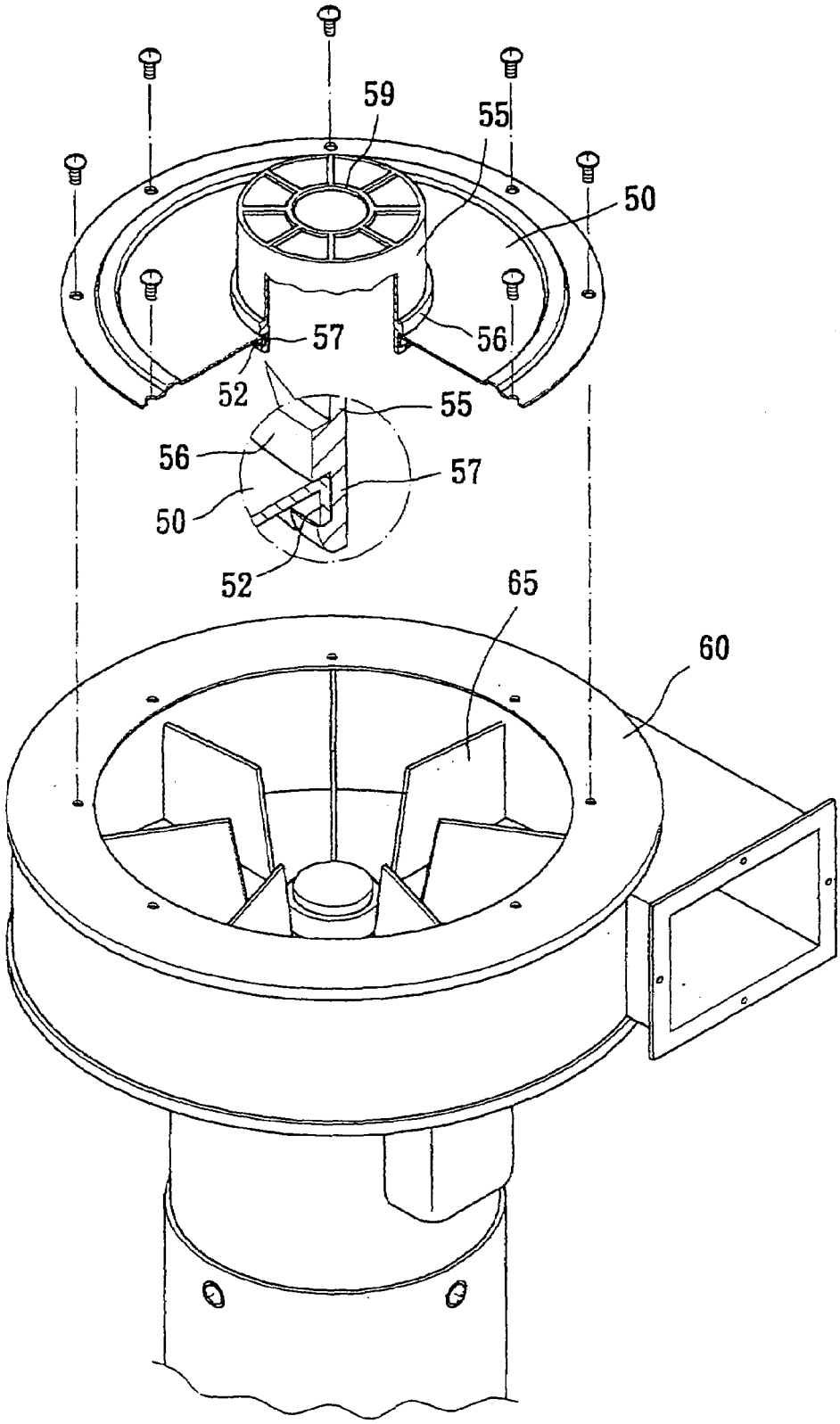
FIG. 5 is a perspective view of the hose connector of the present invention.

The present invention relates to a hose connector for hose of a dust collector. As shown in FIGS. 4 and 5, the hose connector is mounted to the top face of the housing 60 enclosing a blower of a dust collector. Further a blade module 65 is positioned within the housing 60 to vibrate air. The hose connector 55 includes a covering plate 50, so that a hose can be connected to dust collector.

The center of the covering plate 50 of the hose connector 55 is provided with a through hole 51 and the circumferential edge of the through hole 51 of the covering plate 50 is provided downwardly with a stopping rim 52. The extended length of the stopping rim 52 is at least lower than the highest point (as shown in FIG. 6) of the blade module 65 and a curved gap X is formed between the stopping plate 52 and the blade module 65 so as to reduce the air stream moving to the upper portion of the blade module 65.

The hose connector 55 adjacent to the lower edge thereof is protruded with an urging edge 56 which can suitably resist against the upper circumferential edge of the through hole 51 of the covering plate 50. The lower edge of the hose connector 55 is protruded out a fastening block 57 which can engage with the lower edge of the stopping pad 52 at the covering plate 50. The hose connector 55, adjacent the engaging block 57 therebetween, is provided with a protective plate 58 so as to improve the strength of the entire structure. The top face of the host connector 55 is mounted with a grating rim 59 formed integrally with a plurality of ribs so as to prevent large objects from entering the blower, which may damage the blower.

Figure 1:
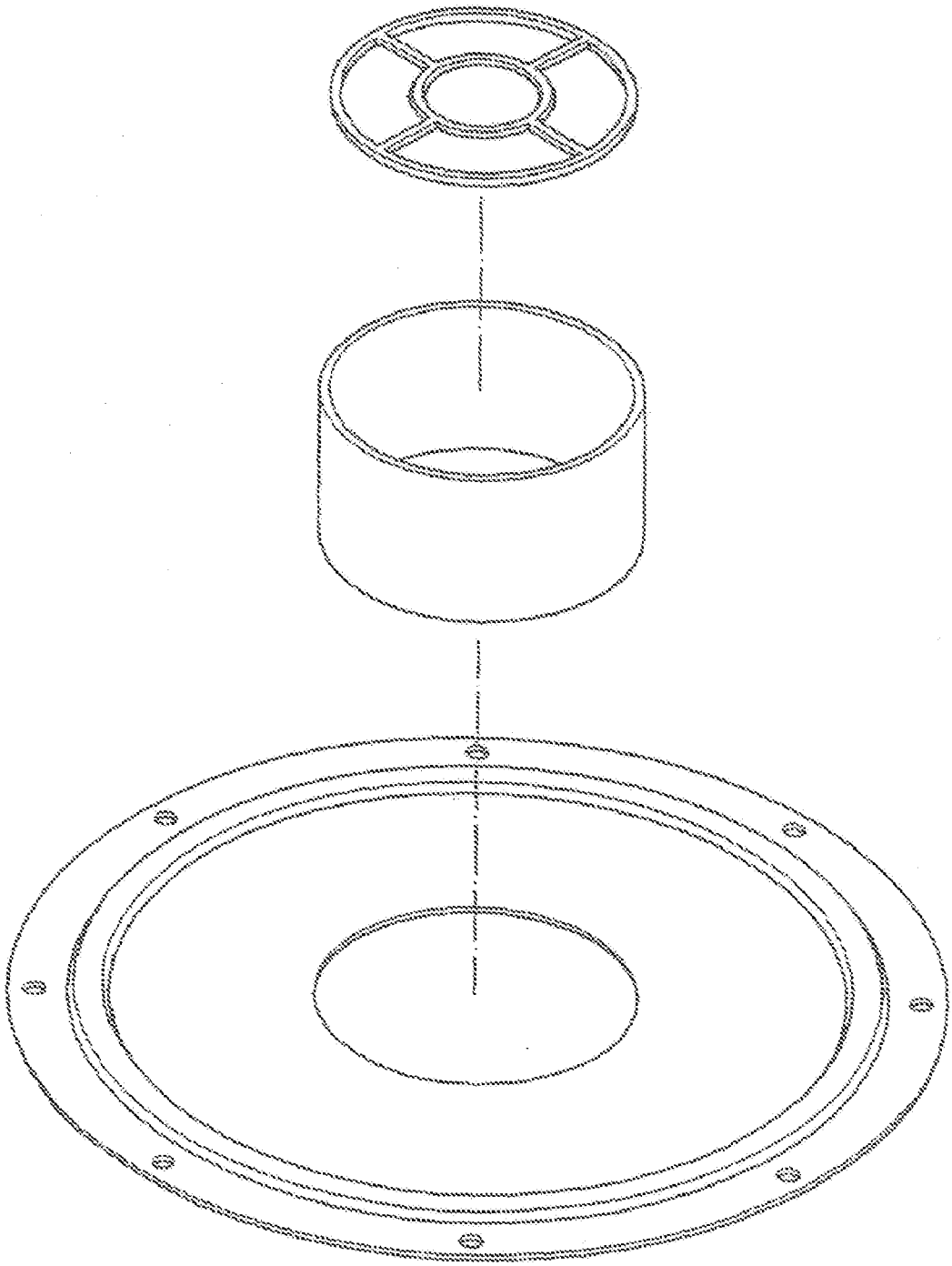
FIG. 1 PRIOR ART
FIG. 1 is an exploded perspective view of a conventional hose connector.
Figure 2A:
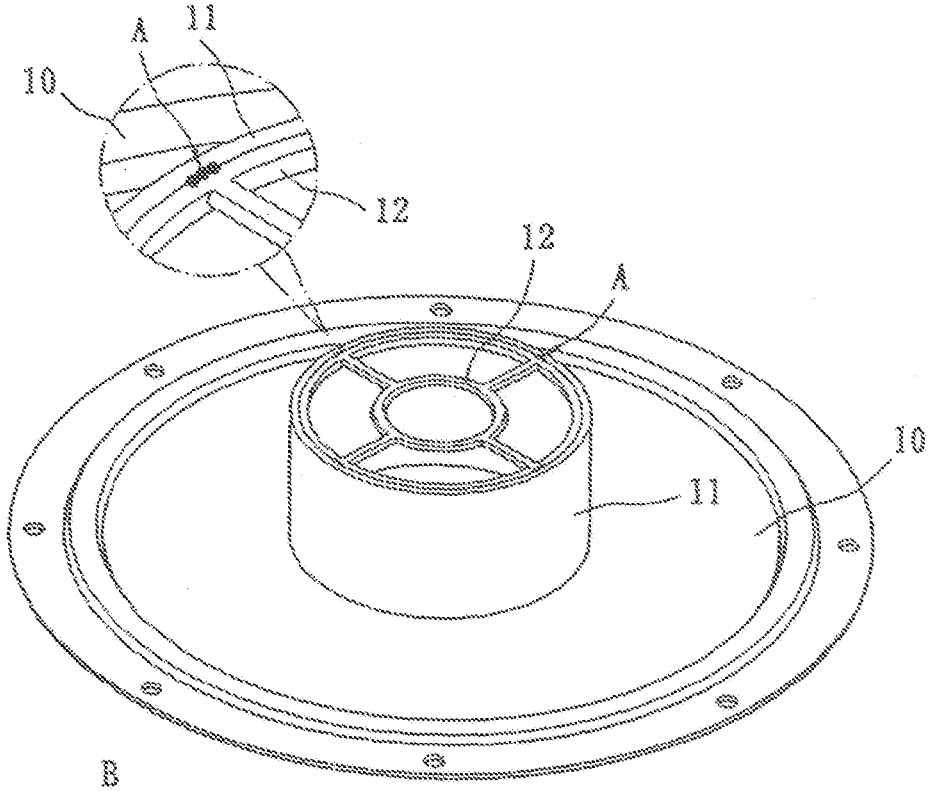
FIG. 2 A PRIOR ART
FIG. 2A is a top view and FIG. 2B is a bottom view thereof
Figure 2B:
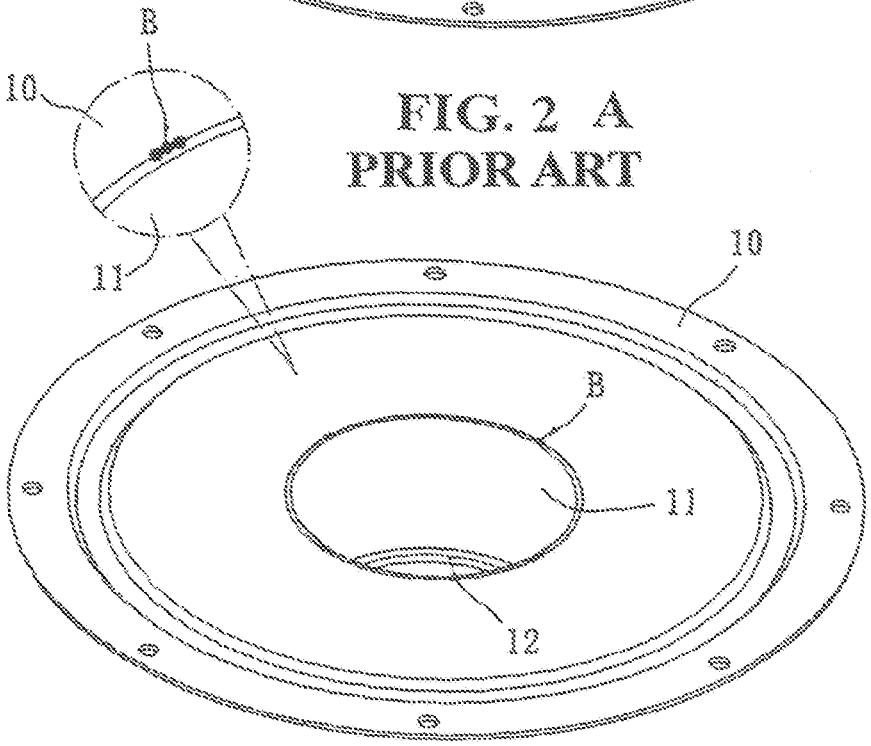
FIG. 2 B PRIOR ART
Figure 3:
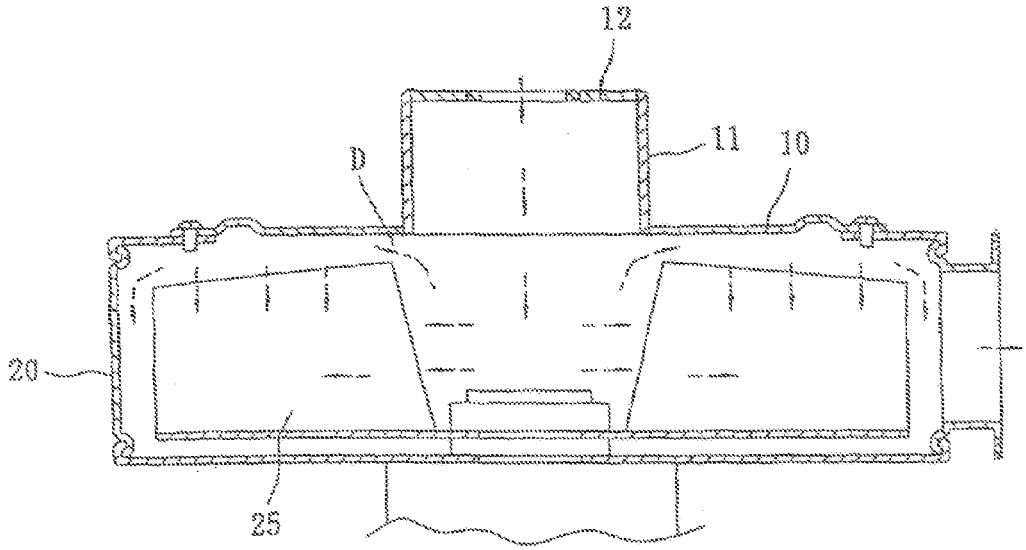
FIG. 3 PRIOR ART
FIG. 3 is a sectional view of a conventional hose connector of a blower.
Figure 6:
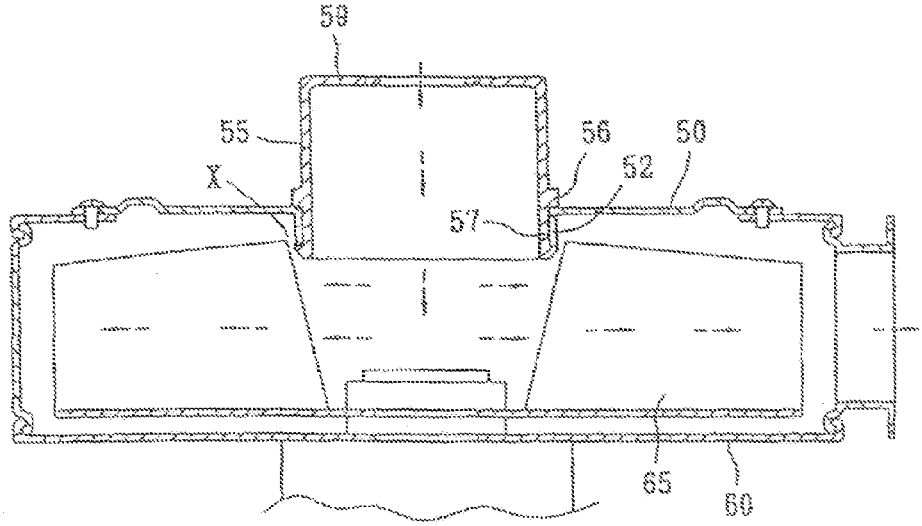
FIG. 6 is a sectional view of the hose connector of the present invention.

As shown in FIGS. 5 and 6, in assembly, the engaging block 57 and the protective plate 58 are inserted into the through hole 51 of the stopping rim 52. Thus, the hose connector 55 can fully be mounted on the covering plate 50, and at the same time, the grating rim 59 being formed integrally with the hose connector 55, the fabrication of the structure is simple and cost effective as lesser fabrication procedures are needed.

In the case where the hose connector 55 is damaged, the engaging block 57 and the stopping pad 52 of the covering plate 50 are separated, the hose connector 55 is then removed without damaging the covering plate 50.

Referring to FIG. 6, by means of the stopping rim 52 extended downward from the circumferential edge of the through hole 51 of the covering plate, a curved gap X is formed between the stopping rim 52 and the blade module 65. Thus, the amount of air stream moving to the upper portion of the blade module 65 is reduced. Accordingly, the turbulence formed by the blower is eliminated and the dust collector efficiency of the blower is greatly improved.

Figure 7:
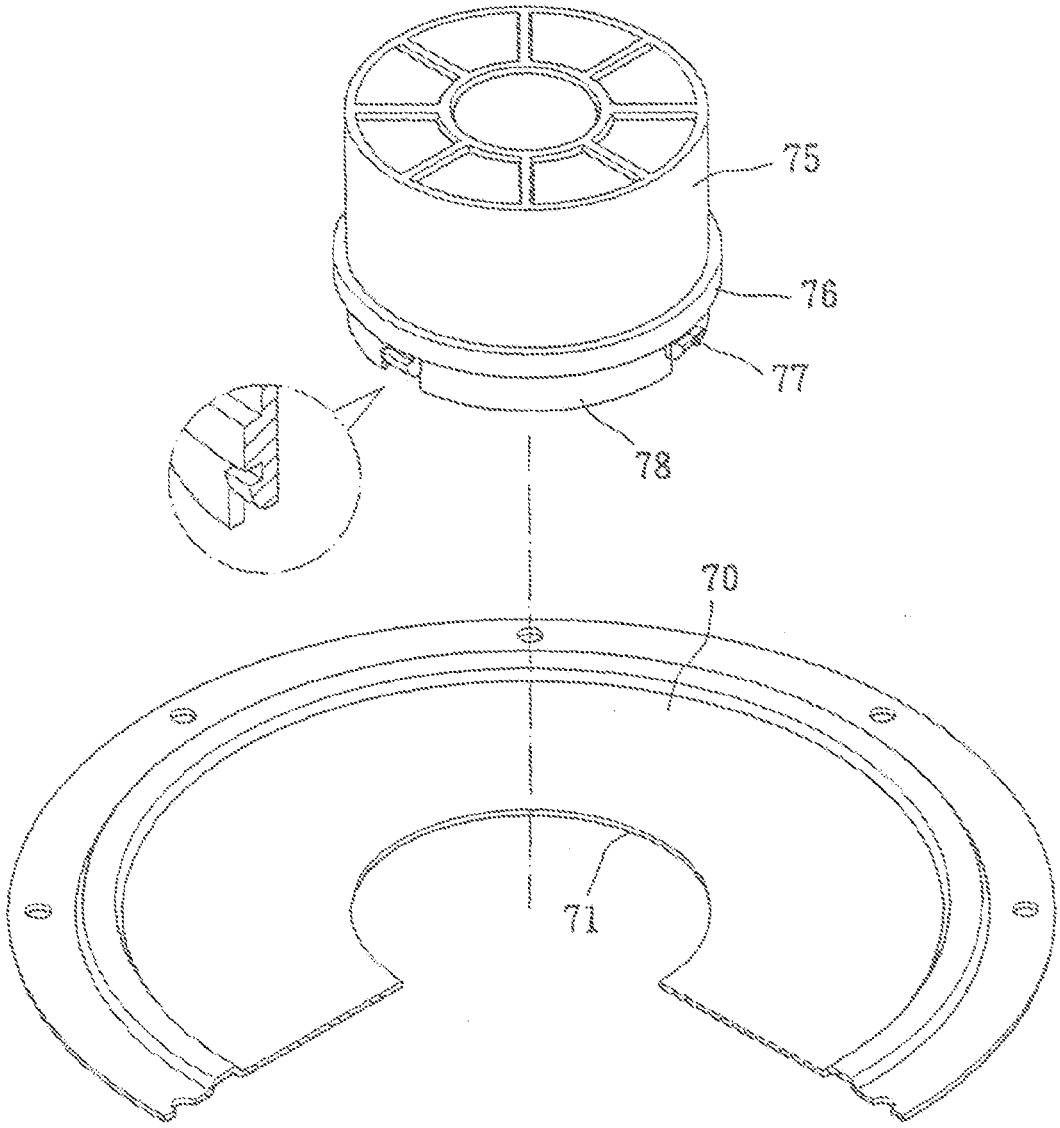
FIG. 7 is a perspective exploded view of a preferred embodiment of the present invention.
Figure 8:
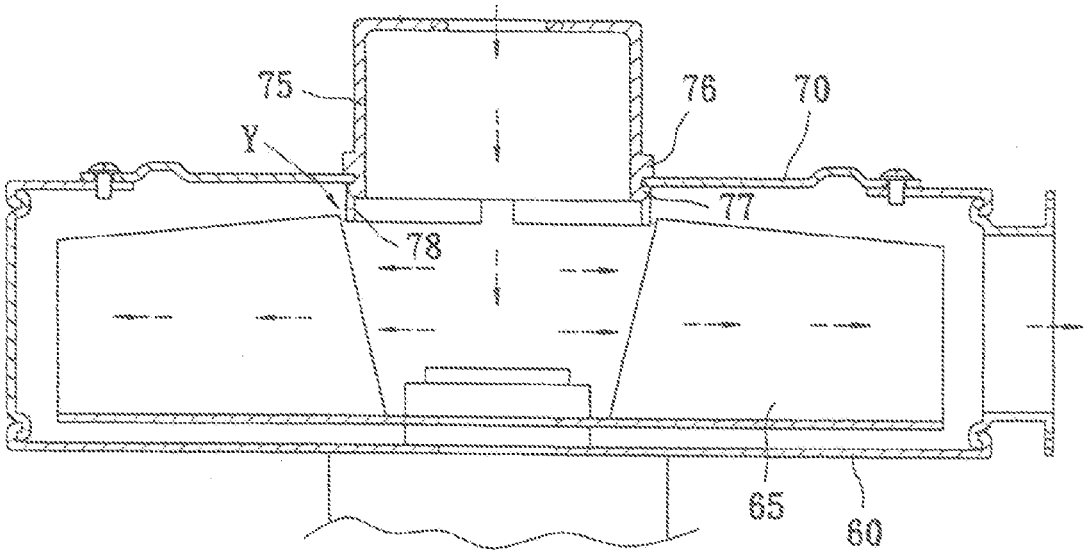
FIG. 8 is a sectional view of a preferred embodiment of the present invention.

FIGS. 7 and 8 show another preferred embodiment of the present invention. The hose connector structure includes a covering plate 70 and a hose connector 75, wherein the center of the covering plate 70 is provided with a through hole 71, and the hose connector 75 adjacent the lower edge thereof, is protruded out an engaging edge 76 which can resist against the surface of the covering plate 70. Further, the bottom edge of the hose connector 75 is protruded with an engaging block 77 which is used to engage with the lower inner edge of the through hole 71 of the covering plate 70. The bottom edge of the hose connector 75 adjacent between the engaging block 77 is provided with a stopping rim 78, and the length of the stopping rim 78, where the hose connector 75 is mounted with a covering plate 70, is at least lower than the top end of the blade of the blade module 65, and a curved gap Y is formed between the stopping rim 78 of the hose connector 75 and the blade module 65 so as to reduce the amount of air stream entering the top portion of the blade module 65.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A hose connector assembly for connecting a hose to a dust collector, the hose connector assembly comprising:

a dust collector having a housing containing a blower;

a blade module;

a covering plate having a center provided with a through hole, said hose connector extending therethrough, and a circumferential edge of said through hole having a stopping pad extending beyond a top end of the blade module thereby forming a curved a gap between the stopping pad and blade module;

a hose connector having a lower edge with an urging edge protruding radially and resting against the outer surface of said covering plate, and said lower edge having an engaging block protruding radially to engage an inner surface of said covering plate;

wherein said stopping pad is disposed adjacent to the engaging block, and having an extended length at least lower than the highest point of the blade module as to reduce air moving to an upper portion of the blade module.

2. A hose connector for hose of a dust collector as claimed in claim 1, wherein said hose connector is provided with a top face including a mating rim having a plurality of ribs to prevent objects from entering said blower.

3. A hose connector for hose of a dust collector as claimed in claim 1, wherein a protective plate is mounted between said hose connector and said engaging block.

* * * * *